US006742441B1

(12) United States Patent
Surjaatmadja et al.

(10) Patent No.: US 6,742,441 B1
(45) Date of Patent: Jun. 1, 2004

(54) CONTINUOUSLY VARIABLE DISPLACEMENT PUMP WITH PREDEFINED UNSWEPT VOLUME

(75) Inventors: Jim B. Surjaatmadja, Duncan, OK (US); Stanley V. Stephenson, Duncan, OK (US)

(73) Assignee: Halliburton Energy Services, Inc., Duncan, OK (US)

( * ) Notice: Subject to any disclaimer, the term of this patent is extended or adjusted under 35 U.S.C. 154(b) by 0 days.

(21) Appl. No.: 10/313,388

(22) Filed: Dec. 5, 2002

(51) Int. Cl.[7] ..... F15B 15/24
(52) U.S. Cl. ..... 92/13.7; 74/836
(58) Field of Search ..... 92/13, 13.1, 13.7, 92/60.5; 74/832, 834, 836, 571; 417/212, 218, 274

(56) References Cited

U.S. PATENT DOCUMENTS

| | | | | | |
|---|---|---|---|---|---|
| 2,414,617 | A | | 1/1947 | Summers | 123/139 |
| 2,592,237 | A | * | 4/1952 | Bradley | 92/13.7 |
| 2,873,611 | A | * | 2/1959 | Biermann | 92/60.5 |
| 2,892,360 | A | * | 6/1959 | Ill | 92/13.7 |
| 4,240,386 | A | * | 12/1980 | Crist | 92/60.5 |
| 4,264,281 | A | | 4/1981 | Hammelmann | 417/218 |
| 5,676,527 | A | | 10/1997 | Ogikubo | 417/218 |
| 6,190,137 | B1 | | 2/2001 | Robbins et al. | 417/221 |
| 6,217,287 | B1 | | 4/2001 | Monk et al. | 417/45 |
| 6,606,935 | B2 | * | 8/2003 | Jones | 92/13.7 |

* cited by examiner

*Primary Examiner*—Thomas E. Lazo
(74) *Attorney, Agent, or Firm*—John W. Wustenberg; Warren R. Kice

(57) ABSTRACT

Apparatus and method for controlling an unswept volume in a piston system. The method includes rotating a shaft around a rotation point to drive a piston within a cylindrical volume in a periodic manner, modifying the stroke length of the piston, and moving the center of the shaft relative to the cylindrical volume such that a change in an unswept volume or compression ratio is controlled.

14 Claims, 6 Drawing Sheets

CONTINUOUSLY VARIABLE DISPLACEMENT PUMP WITH PREDEFINED UNSWEPT VOLUME

BACKGROUND

This invention relates, in general, to piston systems, such as continuously variable displacement pumps, engines, and compressors. Such devices are well known and many include a piston that reciprocates in a cylinder to achieve the pumping action. Many of these systems allow for varying the length of the piston stroke within the cylinder. These systems may include a movable member coupled to a drive shaft. The movable member is connected to the piston via a crankshaft, or similar member for varying the length of the piston stroke. In conventional devices, however, when the piston stroke is shortened, there often is a relatively large unswept volume in the cylinder. As used herein, an "unswept volume" is that section or volume inside the cylinder which is not reached by the piston at a given piston stroke. Large unswept volumes decreases the efficiency of the device. Therefore, what is needed is a device or method which controls or minimizes the unswept volume.

DETAILED DESCRIPTION

Figure 1:
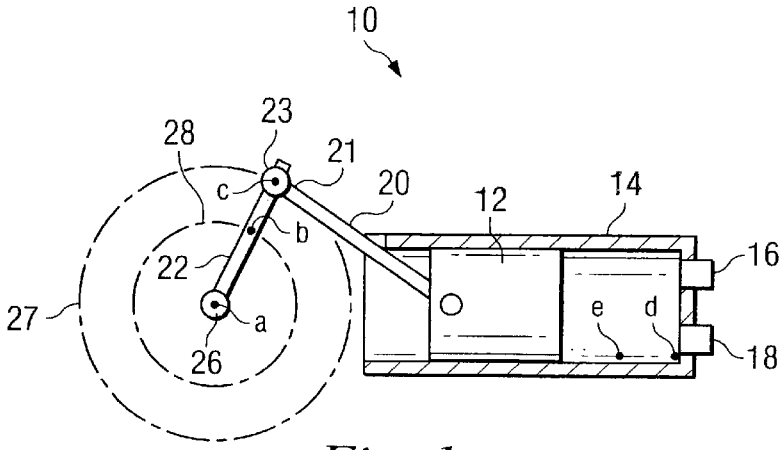
FIG. 1 is a diagrammatic view of one embodiment of a continuously variable displacement pump.

Referring to FIG. 1 of the drawings, the reference numeral 10 refers, in general, to a continuously variable pump. The pump 10 includes a piston 12 mounted in a cylinder 14. As will be explained in greater detail below, the piston 12 slideably moves in the cylinder 14 in a periodic manner. The cylinder 14 may have an intake valve 16 and an exhaust or discharge valve 18 to control fluid flow through the cylinder.

One end of a connecting rod 20 is coupled to the piston 12. The other end 21 of the connecting rod 20 is coupled to a crankshaft 22. The crankshaft 22 is coupled to a power shaft 26 which rotates the crankshaft 22 around a rotation point "a." A connection 23 between the crankshaft 22 and the connecting rod 20 is shown at point "c." The connection 23 can slidingly move between point "a" and point "c" along the crankshaft 22.

In operation, the power shaft 26 turns the crankshaft 22 around point "a," which causes the connection 23, located at point "c," to follow a circular path 27 centered around point "a" in a periodic manner. For the first half of the rotation or periodic cycle, the crankshaft 22 through the connection 23, pushes the connecting rod 20 which in turn will push the piston 12 farther into the cylinder 14 towards the exhaust valve 18, thereby exhausting any fluid in the cylinder 14. During the second half of the rotation, the crankshaft 22 will pull the connecting rod 20, which in turn pulls the piston 12 away from the intake valve 16. This pulling action causes suction, which may draw fluid into the cylinder 14. This cycle is repeated as the crankshaft 22 continues to rotate about the point "a."

It may be desirable to increase or decrease the stroke length or the length of the path traveled by the piston 12. For instance, in order to decrease the stroke length, the connection 23 between the connecting rod 20 and the crankshaft 22 may be slidingly moved from point "c" to point "b." This non-rotational or "lateral" movement decreases the relative distance of the connection 23 from the point "a" and causes the circular motion path of the connection 23 to change from circular path 27 to circular path 28. Because the circular path 27 is larger than circular path 28, the piston 12 will not be pushed as far into the cylinder 14, leaving an unswept volume in the cylinder 14.

In other words, point "c" is at a maximum lateral distance from the point "a" which will cause the stroke length to increase to a maximum point "d" inside the cylinder 14. Similarly, when the connection 23 is moved back to point "b," the maximum stroke of the piston 12 will end at point "e" inside the cylinder 14. Thus, decreasing the stroke length from point "d" to point "e," creates an unswept volume in the cylinder 14. In this illustrative example, therefore, the unswept volume is that volume inside the cylinder 14 in which the piston 12 does not travel at a given stroke length. Thus, when the connection 23 is at point "b," the unswept volume is the volume in the cylinder 14 between point "d" and point "e".

In most hydraulic systems, an unswept volume is acceptable because oil is incompressible and hence its effects on efficiency is small. However, in compressors an unswept volume causes inefficiency because compression ratio changes drastically. Unswept volumes are also not desirable in pumps designed to pump high concentrations of particles in the fluid, for instance, sand. In such a situation, a large amount of fluid is often not replenished, causing sand to drop out of the fluid, and over time, accumulate inside the cylinder. Increasing the stroke length after sand has accumulated in the cylinder may cause the sand in the cylinder area to clog the exit valve.

Figure 2A:
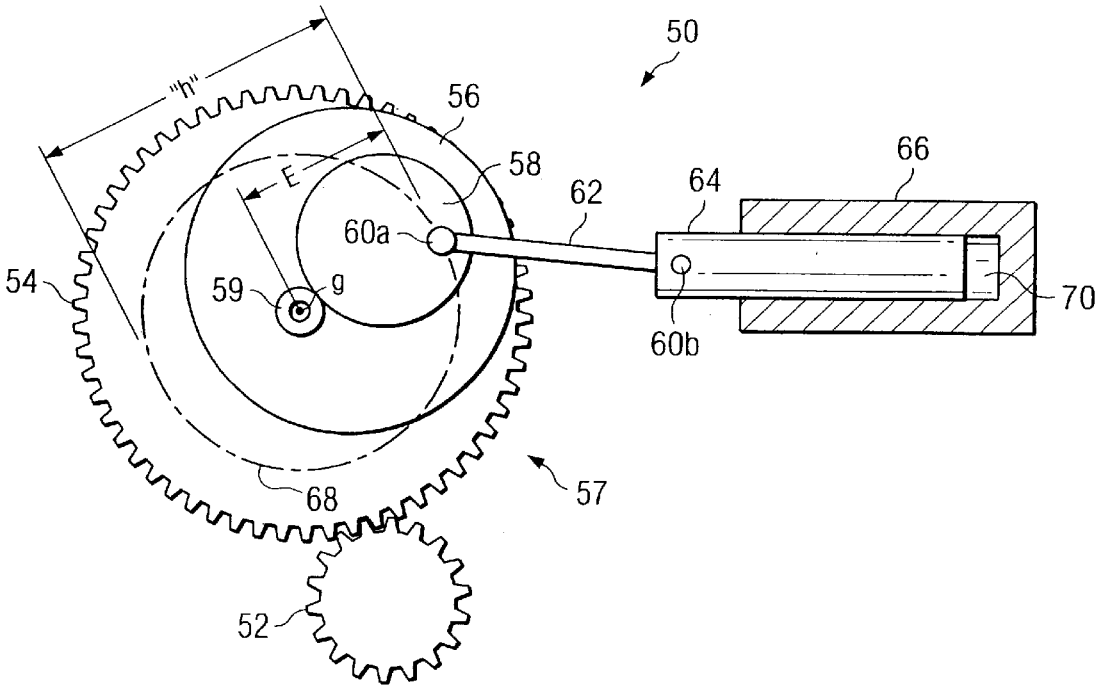
FIG. 2*a* is a diagrammatic view of a piston system employing one embodiment of the present invention.

Turning now to FIG. 2*a*, there is a diagrammatic illustration of a piston system 50 employing several aspects of the present invention. The piston system 50 may have an input power gear or drive gear 52, which in this embodiment, is the primary power source for the system 50. In some embodiments, a plurality of gear teeth extend around the outer circumference of the drive gear 52. The drive gear 52 drives a concentric outer gear or wheel 54 such that the wheel 54 rotates about its longitudinal axis, which is located at a rotation point "g" and is perpendicular to the plane of view. The wheel 54 may also have a plurality of gear teeth extending around its outer circumference which are sized to mesh with the gear teeth of drive gear 52. A cam 56 is fixedly coupled to the wheel 54. The center of the cam 56 is offset from the center of wheel 54 such that the wheel 54 and cam 56 form part of a camshaft or crankshaft assembly 57.

A wheel 58 is rotatably coupled to the cam 56 such that wheel 58 can be made to rotate about its own axis with respect to the cam 56. For instance, if wheel 58 had gear teeth around its perimeter, a control gear 59 could be installed at the center of the wheel 54. Turning the control gear 59 with respect to the wheel 54 causes the wheel 58 to turn about its own axis, thereby adjusting the stroke length of the system 50. When wheel 58 remains fixed with respect to the cam 56, the stroke length of the system 50 remains constant. Thus, as will be explained below, the rotation of wheel 58 acts as an adjusting mechanism to adjust the stroke length of the system 50.

The wheel 58 may be coupled to one end 60*a* of a linkage or connecting rod 62. The other end 60*b* of the connecting rod 62 is coupled to a piston 64, which slidingly engages a cylindrical volume or cylinder 66 in a typical manner known in the art.

As will be explained in greater detail below, a second adjusting mechanism (not shown) may be coupled to the crankshaft assembly 57 (e.g., the wheel 54, the wheel 56, the wheel 58, and the control gear 59) to rotate the crankshaft assembly 57 about the drive gear 52.

In operation, as the drive gear 52 rotates, the teeth on the perimeter of the drive gear 52 mesh with teeth on the perimeter of the wheel 54. This meshing causes the wheel 54 to rotate about point "g." The cam 56 and the wheel 58 remain fixed relative to the wheel 54. Thus, they also rotate around the point "g." Consequently, the end 60*a* of the connecting rod 62 will also rotate in a circular path 68 about point "g." As the end 60*a* rotates about point "g", it will cause the piston 64 to slidingly move within the cylinder 66.

The diameter "h" of the circular path 68 is the stroke length for the system 50 when the end 60*a* of the connecting rod 62 is located at a given distance or eccentricity "E" from the point "g." As illustrated in FIG. 2*a*, the end 60*a* is not at a maximum eccentricity. Thus, the stroke length is also not at a maximum value. Consequently, there may be a small unswept volume 70 in the cylinder 66.

As discussed previously, the stroke length "h" of the system 50 may be changed by moving the eccentricity "E" (e.g., moving the end 60*a* of the connecting rod 62 closer to the point "g"). In the embodiment illustrated in FIG. 2*a*, this may be accomplished by rotating the control gear 59 counterclockwise with respect to the wheel 54, which in turn, will cause the wheel 58 to turn clockwise with respect to the wheel 54. The clockwise rotation of the wheel 58 by less than a 180 degree rotation will reduce the eccentricity "E," and thus, reduce the stroke length "h" of the system 50.

Figure 2B:
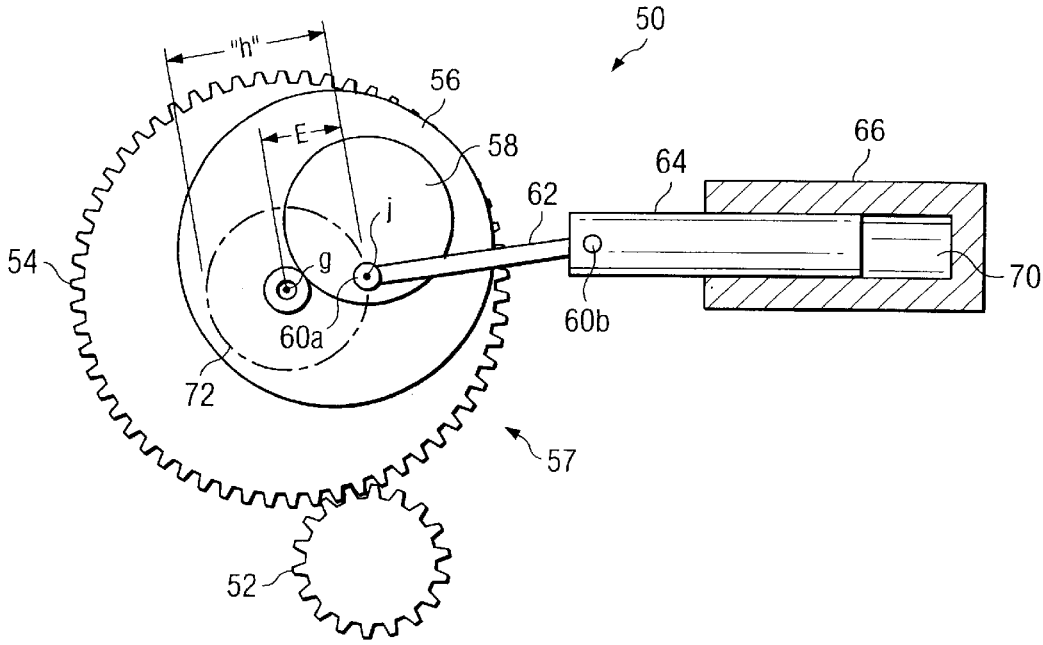
FIG. 2*b* is a diagrammatic view of the system of FIG. 2*a* illustrating a change in stroke length and the associated change in unswept volume.

Turning now to FIG. 2*b*, the system 50 is illustrated after the wheel 58 has been rotated clockwise and the eccentricity "E" has been reduced. The end 60*a* of the connecting rod 62 is now located at point "j" which is closer to the point "g." Because the end 60*a* is closer to the axis of rotation, the stroke length "h" is significantly reduced. Additionally, when the wheel 54 is rotated around point "g," the end 60*a* will now follow a smaller circular path 72. However, as explained in reference to FIG. 1, the unswept volume 70 within the cylinder 66 will also increase due to this decrease in stroke length "h".

Figure 2C:
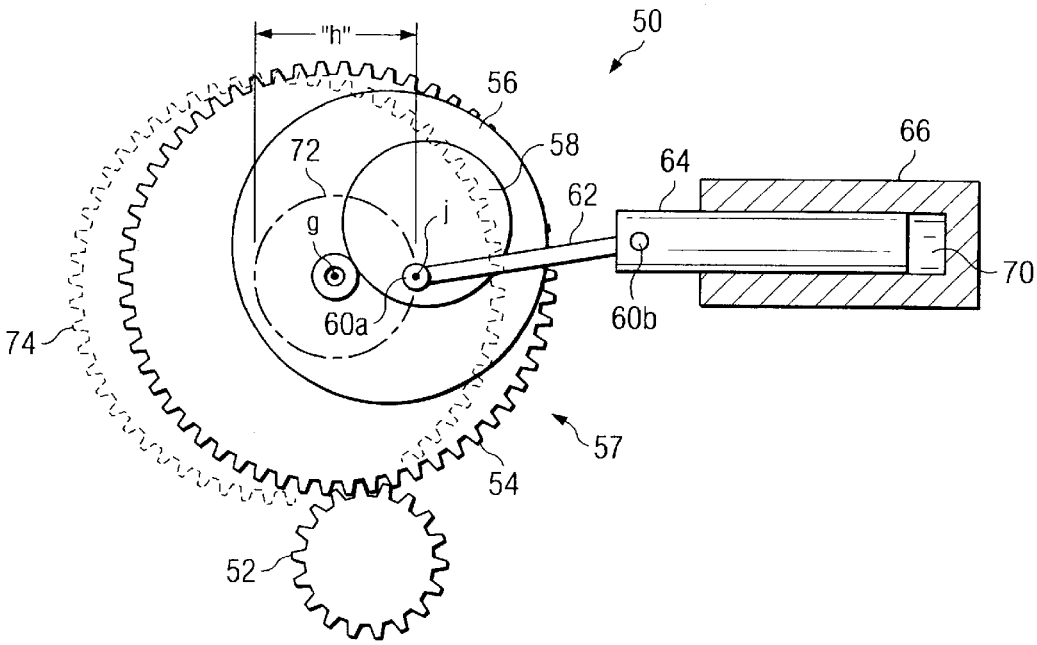
FIG. 2*c* is a diagrammatic view of the system of FIG. 2*a* illustrating a change in stroke length and a compensated unswept volume.

To reduce the unswept volume in the cylinder 66 due to the decrease in stroke length "h", an adjusting mechanism (not shown) may rotate the entire crankshaft assembly 57 about the drive gear 52. Such a situation is illustrated in FIG. 2*c*, where an outline 74 shows the previous position of the crankshaft assembly 57 in relation to the new position after rotation. As illustrated in FIG. 2*c*, the stroke length "h" and the circular path 72 of the end 60*a* are the same magnitude as in FIG. 2*b*. However, because the end 60*a* is now positioned closer to the cylinder 66, the unswept volume 70 within the cylinder 66 has been significantly reduced.

Figure 3:
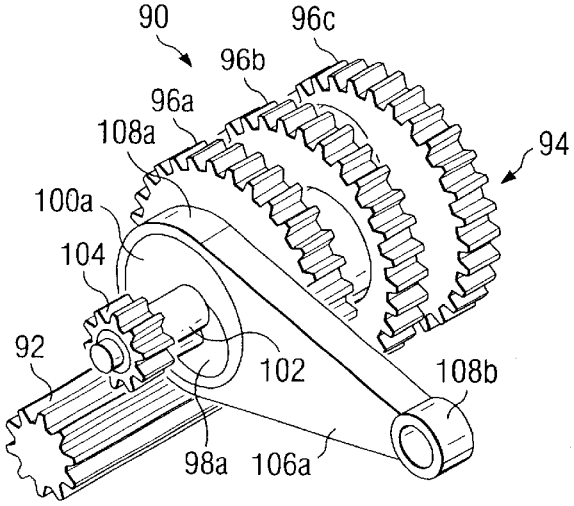
FIG. 3 is a partial isometric view of a piston system employing one embodiment of the present invention.

Turning now to FIG. 3, there is partial view of one embodiment of a drive system or power end system 90 which could be used in a piston system employing one embodiment of the present invention. The system 90 has an input power gear or drive gear 92, which in this embodiment is the primary power source for the system 90. The drive gear 92 has an engaging means, such as a plurality of gear teeth extending around the outer circumference of the drive gear 92. The drive gear 92 drives a camshaft or crankshaft 94. As will be explained in more detail below, in this embodiment, the crankshaft 94 comprises four outer gears. Outer gears 96*a*, 96*b*, 96*c* are shown in FIG. 3. A fourth outer gear 96*d* is located in front of a fixed cam 98*a*, but is not shown for reasons of clarity. At least one of the outer gears 96*a*–96*d* has a means to engage the drive gear 92, such as a plurality of gear teeth extending around each of the respective outer circumference. The gear teeth are sized to mesh with the gear teeth of drive gear 92. The fixed cam 98*a* is fixedly coupled to side surfaces of the outer gear 96*a* and outer gear 96*d* (not shown). Additionally, between the outer gears 96*a*–96*c*, there are two more fixed cams 98*b*–98*c* fixedly coupled to the outer gears 96*a*–96*c* (only one fixed cam 98*a* is visible in FIG. 3). The centers of each of the fixed cams 98*a*–98*c* are offset from the center of the outer gears 96*a*–96*c* such that the outer gears 96*a*–96*d* and fixed cams 98*a*–98*c* form the crankshaft 94.

Surrounding each of the fixed cams 98*a*–98*c* are rotatable cams 100*a*–100*c*, respectively. Only rotatable cam 100*a* is visible in FIG. 3. The rotatable cam 100*a* is coupled to the fixed cam 98*a* such that the rotatable cam 100*a* can be made to rotate about its center axis with respect to the fixed cam 98*a*. A primary shaft or control shaft 102 is positioned in the center of the crankshaft 94. As will be explained in greater detail below, the control shaft 102 may be adapted to control the rotation of the rotatable cams 100*a*–100*c* with respect to the fixed cams 98*a*–98*c*, respectively. The control shaft 102 is also coupled to a primary control gear 104 positioned around one end of the control shaft 102.

In the illustrative embodiment, three connecting rods 106*a* through 106*c* are coupled to the rotatable cams 100*a*–100*c*, respectively. However, for reasons of clarity, only connecting rod 106*a* is shown in FIG. 3. The connecting rod 106*a* is positioned such that one end 108*a* surrounds the rotatable cam 100*a*. Another end 108*b* of the connecting rod 106*a* is adapted to couple to a piston, which is also not shown for reasons of clarity. In a similar manner, connecting rods 106*b* and 106*c* are coupled to the rotatable cams 100*b* and 100*c* and the respective pistons.

Figure 4B:
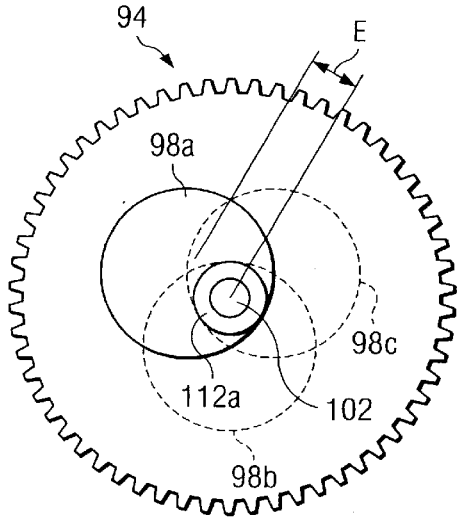
FIG. 4*b* is a section view of the camshaft of FIG. 4*a*.
Figure 4A:
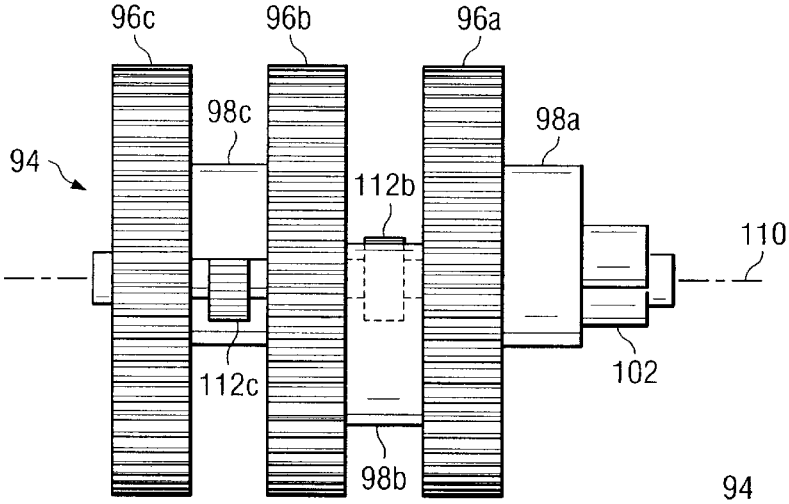
FIG. 4*a* is an isometric view of a camshaft which may be used in the system of FIG. 3.

Turning now to FIG. 4*a*, there is illustrated a side view of the crankshaft 94. In FIG. 4*a*, the rotatable cams 100*a*–100*c* are removed so that the fixed cams 98*a*–98*c* can be seen between the outer gears 96*a*–96*d*. At the center of the primary shaft 102, there is a longitudinal axis 110. The outer gears 96*a*–96*d* are concentrically spaced along the longitudinal axis 110, with the fixed cams 98*a*–98*c* spaced between the outer gears 96*a*–96*d*.

FIG. 4*b* is a transverse view cut facing through the fixed cam 98*a*. In this figure, the relative lateral positions of the fixed cams 98*a*–98*c* can be seen. As illustrated, the center of the fixed cams 98*a*–98*c* are offset in a lateral direction or eccentricity "E" from the center. The longitudinal axis 110 is located at the center, which in this view is perpendicular to the plane of viewing. The fixed cams 98*a*–98*c* are also radially separated from each other about the longitudinal axis 110. In the illustrative embodiment, this radial separation is 120 degrees.

Figure 4C:
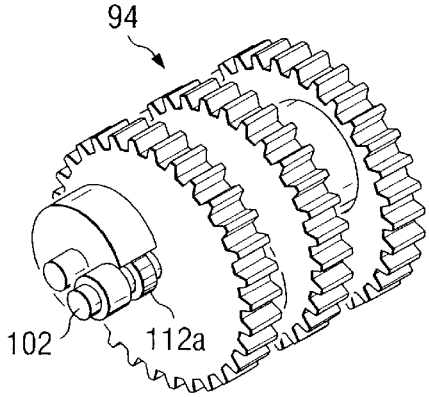
FIG. 4*c* is another isometric view of the camshaft of FIG. 4*a*.

Each of the fixed cams 98*a*–98*c* houses an internal or secondary control gear. Portions of secondary control gears 112*b* and 112*c* are visible in FIG. 4*a*. A secondary control gear 112*a* is hidden from view in FIG. 4*a* by the fixed cam 98*a*. However, the secondary control gear 112*a* is visible in FIG. 4*c*, which is another isometric view of the system 90. As illustrated in FIGS. 4*a* and 4*c*, the secondary control gears 112*a*–112*c* are positioned around the control shaft 102. The secondary control gears 112*a*–112*c* have gear teeth extending around their outer circumference which are sized to mesh with the gear teeth on interior surfaces of the rotatable cams 100*a*–100*c*, respectively. Thus, by turning the control gears 112*a*–112*c* with respect to the fixed cams 98*a*–98*c*, the rotatable cams 100*a*–100*c* can also be made to turn with respect to the fixed cams 98*a*–98*c*. This rotation allows the center of the rotatable cams 98*a*–98*c* to move laterally with respect to the longitudinal axis 110 or center of the crankshaft 94.

Thus, the rotatable cams 100*a*–100*c* form one embodiment of an adjustment mechanism for adjusting the stroke length of the system 90. By rotating the rotatable cams 100*a*–100*c* relative to the fixed cams 98*a*–98*c*, respectively, the center of the rotatable cams 100*a*–100*c* will change relative to longitudinal axis 110. The end 108*a* of the connecting rod 106*a*, for example, is centered on the rotatable cam 100*a*. Thus, by changing the distance from the center of the rotatable cam 100*a*, the end 108*a* of the connecting rod 106*a* also moves with respect to the longitudinal axis 110. As previously explained with reference to FIGS. 2*a*–2*c*, changing the relative position of the end 108*a* of the connecting rod 106*a*, will adjust the stroke length of the system 90.

Figure 5A:
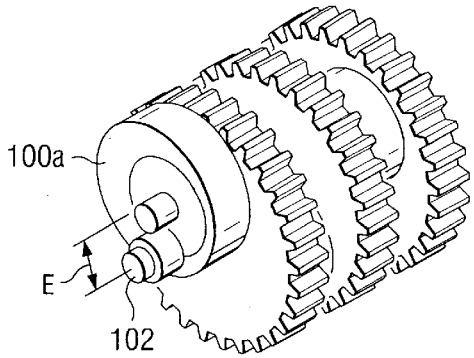
FIG. 5*a* is an isometric view of the camshaft of FIG. 4 coupled to a rotatable cam.

For instance, FIG. 5*a* illustrates a situation where the rotatable cam 100*a* is in a maximum position, in other words, the center of the rotatable cam 100*a* is at a maximum eccentricity "E" from the longitudinal axis 110 or center of the control shaft 102. Consequently, when coupled to the connecting rod 106*a* (not shown), the center of the end 108*a* would also be at a maximum eccentricity from the center of the crankshaft 94. As those skilled in the art would recognize, the stroke length of the system 90 would also be at a maximum. In turn, the unswept volume in any associated cylinder would be at a minimum.

Figure 5B:
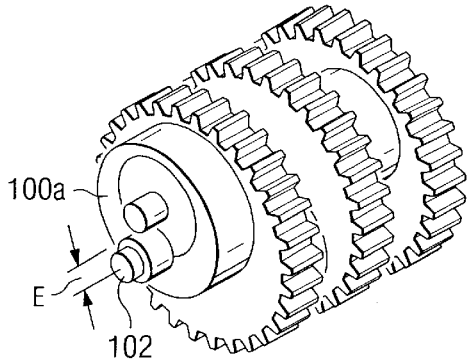
FIG. 5*b* is another isometric view of the camshaft of FIG. 4 coupled to the rotatable cam.

In contrast, FIG. 5*b* illustrates a situation where the rotatable cam 100*a* is at a minimum eccentricity "E". In other words, the center of the rotatable cam 100*a* has been rotated 180 degrees about its own axis. Consequently, if the center of the crankshaft 94 remains stationary, the center of the end 108*a* of the connecting rod 106*a* would also be at a minimum distance from the center of the crankshaft 94. The stroke length for the system 90 would be at a minimum, and the unswept volume in any associated cylinder would be at a maximum.

Figure 6:
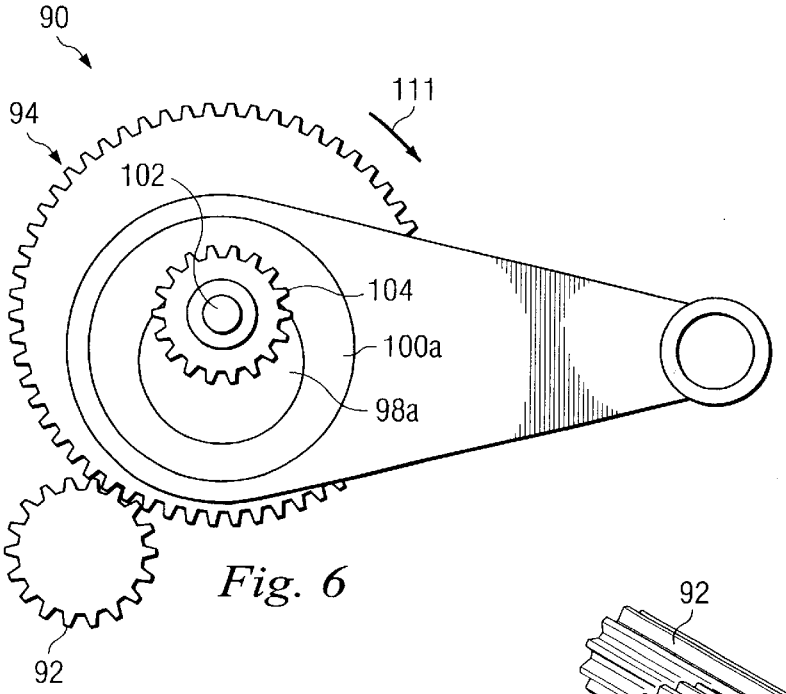
FIG. 6 is another isometric view of the system of FIG. 3.

Turning to FIG. 6, there is a side view of the system 90 illustrated in FIG. 3. As explained in reference to FIG. 5, the rotation of the rotatable cams 100*a*–100*c* relative to the fixed cams 98*a*–98*c* acts as an adjustment mechanism to control the stroke length of the system 90. The amount of rotation of the rotatable cams 100*a*–100*c* can be controlled by several mechanisms. For instance, an independent prime motor (not shown) may be installed on or connected to the control gear 104. Thus, engaging the motor would cause rotation of the rotatable cams 100*a*–100*c*. If the motor is not engaged, the control gear 104 would rotate with the same speed as the crankshaft 94 and thus, would not turn the rotatable cams 100*a*–100*c*. In such an embodiment, the control gear 104 could be locked when not being turned by the motor using techniques well known in the art, such as slidingly moving the control gear 104 into a locking spline (not shown). To control when the motor would be engaged, a control unit (not shown) could unlock the control gear 104 causing it to engage the motor. Such control units are well known in the art. The control unit could comprise a switch to pull and unlock the control gear 104 in combination with another switch which is pushed momentarily to turn the motor. Alternatively, the control unit could be a microprocessor system which can unlock the control gear 104 and turn it to a predetermined angle to adjust the stroke length.

Alternatively, a motor could be mounted independently from the system 90 such that it turns the control gear 104 in a manner so that the rotational velocity of the control gear 104 is the same rotational velocity as the crankshaft 94. The change in the stroke length may then be performed by changing the motor speed (increasing or decreasing) relative to the rotation of the crankshaft 94 until a desired angular relative movement is achieved.

Figure 7:
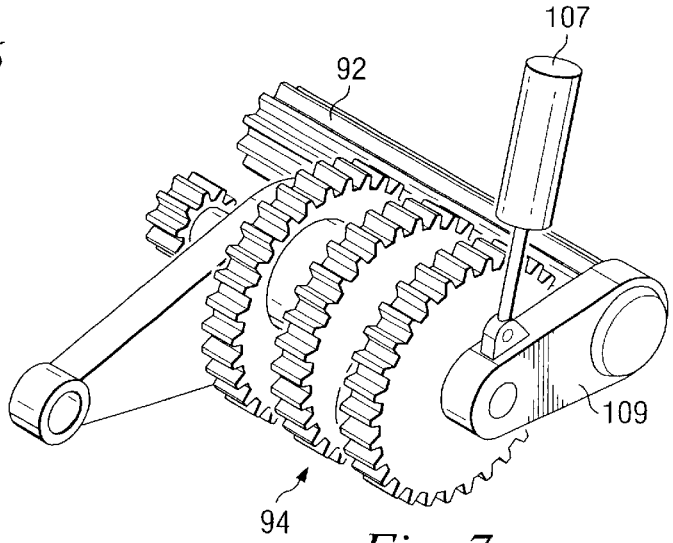
FIG. 7 is an isometric view of the system of FIG. 3 with additional components.

As explained above, varying the stroke length may cause an unwanted change in the unswept volume or compression ratio of the system 90. Thus, the system 90 is coupled to a mechanism (not shown in FIG. 6) for rotating the crankshaft 94 about the drive gear 92 or another pivot point. Such an adjusting mechanism would, in effect, adjust the unswept volume by controlling the rotation of the crankshaft 94 about the drive gear 92. The adjusting mechanism could also rotate the crankshaft 94 to adjust the compression ratio to a predetermine value. Such an adjustment mechanism may include a screw type actuator, or a hydraulic cylinder 107 as shown in FIG. 7. A connecting member 109 is used to keep the drive gear 92 and outer gears 96*a*–96*d* in engagement with each other. Additionally, part of the enclosure for the system 90 (not shown) may also be coupled to the connecting member 109. A control unit could also compute the required movement of the crankshaft 94 relative to the respective cylinder (not shown) to achieve the desired value for either the unswept volume or the combustion ratio. The rotation position of the control gear 104 can be controlled using sensors and known control technologies, such as shaft encoders or magnetic sensors.

The operation will be discussed with reference to FIG. 6. The drive gear 92 engages the outer gears 96*a*–96*d* causing the outer gears 96*a*–96*d* to turn in a direction 111 about the center of the control shaft 102. Because the outer gears 96*a*–96*d* are coupled to the fixed cams 98*a*–98*c*, the fixed cams 98*a*–98*c* also rotate in the direction 111 about the center of the control shaft 102. Similarly, the rotatable cams 100*a*–100*c* rotate around the center of the control shaft 102, which in turn, causes the end 108*a* of the connecting rod

106*a* to rotate about the center of the control shaft 102. As explained previously, the rotation of end 108*a* causes the piston (not shown) to slidingly move within a cylindrical volume (not shown) in a periodic manner.

In order to adjust the stroke length of the piston in the cylinder, the motor (not shown) could be engaged to turn the control gear 104, thus turning the control shaft 102. The control shaft 102 thus turns the secondary control gears 112*a*–112*c* (not shown in FIG. 6). As discussed previously, the secondary control gears 112*a*–112*c* control the rotation of the rotatable cams 100*a*–100*c* (only rotatable cam 100*a* is shown in FIG. 6) with respect to the fixed cams 98*a*–98*c*.

Thus, when the motor is engaging the control gear 104, the rotatable cams 100*a*–100*c* will rotate with respect to the fixed cams 98*a*–98*c*, respectively, changing the stroke length of the system 90. After (or during) the changing of the stroke length, the adjusting mechanism described above can rotate the crankshaft 94 around the drive gear 92 to adjust the unswept volume to a desired value (for instance a minimum or maximum value). The center of the crankshaft 94 could also be rotated to adjust the compression ratio to a predetermine value. The control unit could compute the required movement of the crankshaft 94 relative to the respective cylinder (not shown) to achieve the desired value for the unswept volume or combustion ratio.

Figure 8:
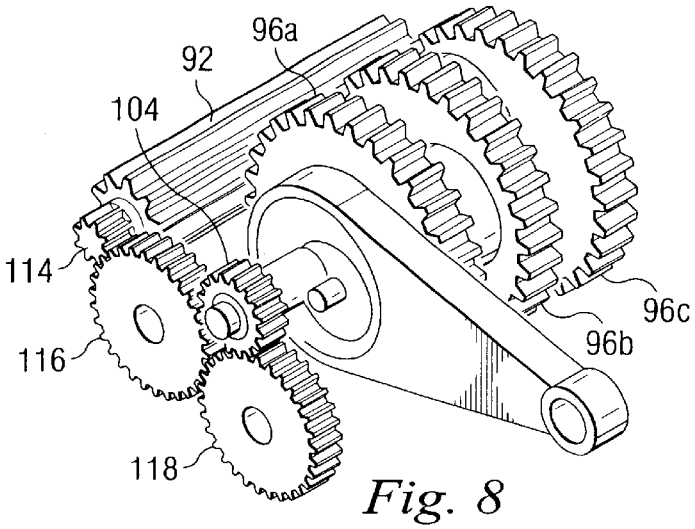
FIG. 8 is a partial isometric view of a piston system employing another embodiment of the present invention.

Turning now to FIG. 8, there is illustrated the system 90 employing alternative mechanical mechanism to adjust the unswept volume or compression ratio. In this embodiment, the velocity of the drive gear 92 will equal the velocity of the control gear 104. The drive gear 92 is coupled to a secondary drive gear 114. The secondary drive gear 114 engages a first connector gear 116. The first connector gear 116 engages a second connector gear 118. The second connector gear 118 engages the control gear 104. Additionally, in order for the velocity of the drive gear 92 to be identical to the velocity of the control gear 104, the ratio of the outside diameter (D1) of the outer gears 96*a*–96*d* to the outside diameter (D2) of drive gear 92 is made the same as the ratio of the outside diameter (D5) of the control gear 104 to the outside diameter (D3) of the secondary drive gear 114.

For convenience, the following variables are used herein:

D1—the outside diameter of outer gears 96*a*–96*d*,

D2—the outside diameter of the drive gear 92,

D3—the outside diameter of the secondary drive gear 114,

D4—the outside diameter of the first connector gear 116,

D5—the outside diameter of the control gear 104,

D6—the outside diameter of the control shaft 102, and

D7—the outside diameter of the fixed cam 98*a*.

Figure 8A:
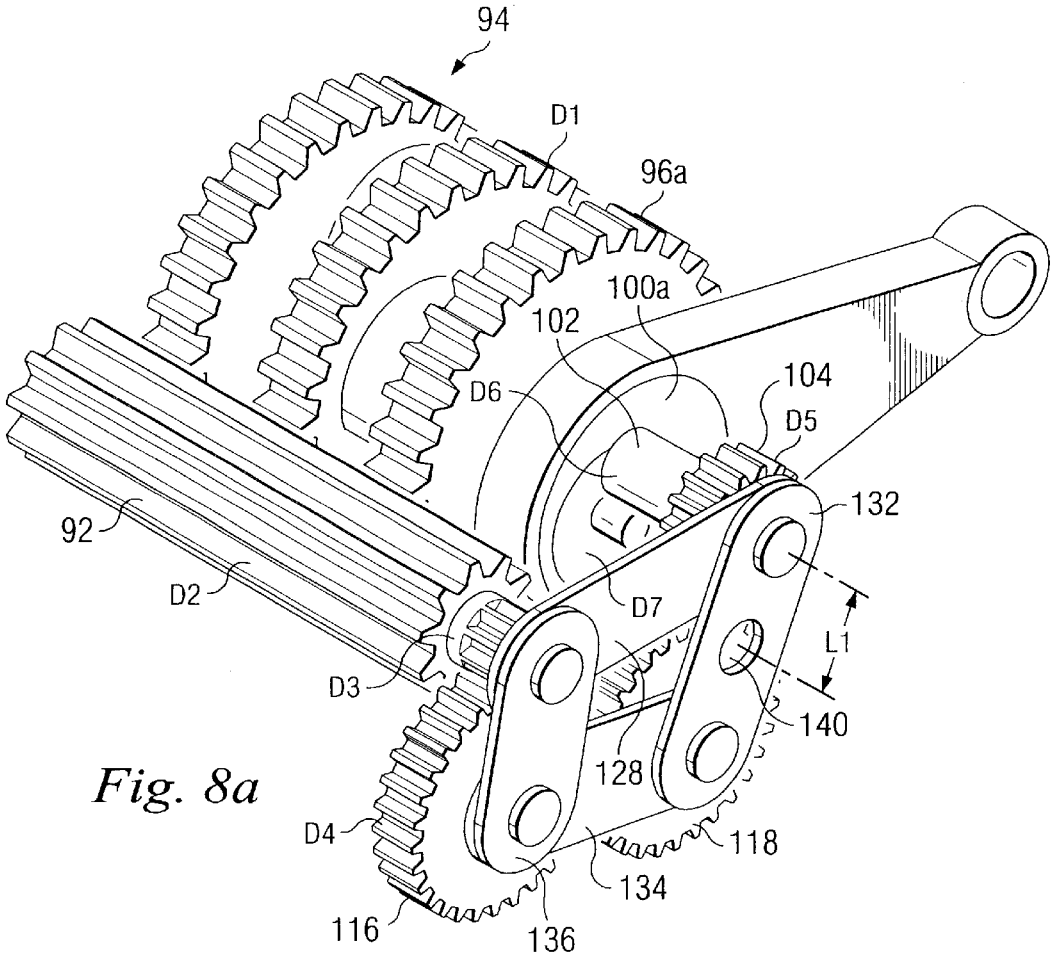
FIG. 8*a* is an isometric view of the system of FIG. 8 with additional components.

Turning now to FIG. 8*a*, there is the embodiment of FIG. 8 showing connecting members 128, 132, 134, and 136. In this embodiment, the position of the control gear 104 relative to the drive gear 92 is fixed. The connecting member 128 couples the shaft of the drive gear 92 and the control gear 104 such that they will be a fixed distance apart. The connecting member 132 also couples the second connector gear 118 to the control gear 104. Two shafts of the connector gears 116 and 118 are coupled to each other by the connecting member 134. Similarly, the connecting member 136 couples a shaft of the first connector gear 116 to a shaft of the drive gear 92.

A pivot point 140 is positioned on the connecting member 132. The connecting member 132 and the entire system 90 can be rotated about the pivot point 140, which is stationary relative to the cylinder (not shown) of the system 90. As the adjusting mechanism rotates the connecting member 132 and the system 90 around the pivot point 140, the stroke length and the unswept volume will change in response to the rotation. Thus, the stroke length and the unswept volume can be controlled by adjusting the degree of rotation around the pivot point 140. Conversely, the location of the pivot point 140, (e.g., the longitudinal distance (L1) of the pivot point 140 from the center of the control gear 104) can also be positioned to affect the unswept volume or the fixed compression ratio for the system 90.

For instance, it is possible to keep the unswept volume constant by positioning the pivot point 140 at a predetermined value of the distance L1 from the center of the crankshaft 94. In order to conveniently compute the value of distance L1 necessary to keep the unswept volume constant, the following variables are used herein:

N1—the rotation of outer gears 96*a*–96*d*,

N2—the rotation of the drive gear 92,

N3—the rotation of the secondary drive gear 114,

N4—the rotation of the first connector gear 116,

N5—the rotation of the control gear 104,

N6—the rotation of the control shaft 102, and

N7—the rotation of the fixed cam 98*a*.

As discussed previously, in this embodiment, the gear ratio D1/D2 equals D5/D3 so that the rotational velocity of the drive gear 92 equals the rotational velocity of the crankshaft 94. Additionally, one skilled in the art would recognize that the maximum stroke and the minimum stroke can be achieved by a 180 degree rotation of the rotatable cam 100*a*. Given these gear ratios, the variables defined above, and the overall configuration discussed previously, one skilled in the art would recognize that the required distance L1 to maintain a constant unswept volume is:

$$L1=E/(\tan(\alpha/2)$$

where $\alpha$=N5*D5/D4*360 (in degrees),

N5=N6=D7/(2*D6), and

E is the eccentricity of the fixed cam 98*a*.

On the other hand, if it is desired to maintain a constant compression ratio rather than a constant unswept length, the required distance L1 can be determined from the following formula:

$$L1=(E+EX/(S+E))/\tan(\alpha/2)$$

where S is the medium stroke of the system,

S+E is the maximum stroke of the system,

S−E is the minimum stroke of the system,

X is the unswept length at the maximum stroke, and

Y is the unswept length at the minimum stroke (or Y=(S−E)*X/(S+E)).

Thus, it is possible to configure this embodiment by positioning the pivot point 140 to either achieve a constant unswept volume or a constant compression ratio. It is also possible to have configurations where the unswept volume and the compression ratio are varied by varying the position of the pivot point 140 from the center of the control shaft 102, i.e., distance L1.

The operation of this embodiment is similar to that described above with reference to FIG. 6, except that the adjusting mechanism rotates the entire system 90 around the pivot point 140 to either control the unswept volume or the compression ratio.

Figure 9:
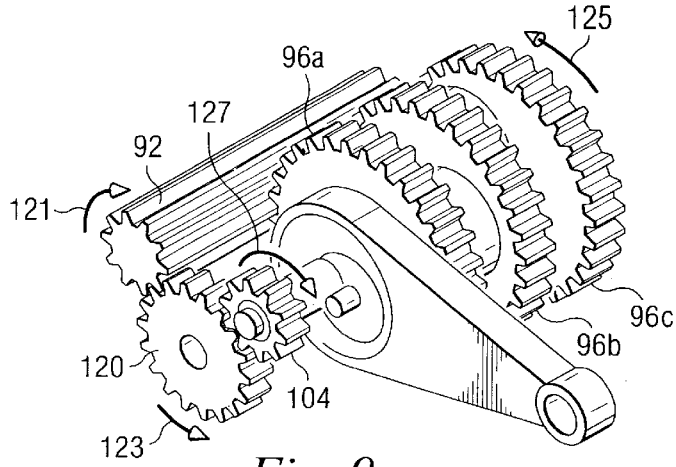
FIG. 9 is a partial isometric view of a piston system employing another embodiment of the present invention.

Another embodiment is illustrated in FIG. 9. In this embodiment, the drive gear 92 engages the outer gears 96*a*–96*d* and a single connector gear 120. Because a single connector gear 120 is used, the outer gears 96*a*–96*d* will rotate in a different rotational direction than the control gear 104. For instance, assume the drive gear 92 rotates in a clockwise direction 121. Then, the connector gear 120 and the outer gears 96*a*–96*d* will rotate in a counterclockwise direction 123 and 125, respectively. The connector gear 120 engages the control gear 104 causing it to rotate in a clockwise direction 127. Thus, the clockwise direction 127 of rotation of the control gear 104 is reversed relative to the counterclockwise direction 125 of the outer gears 96*a*–96*d*.

Figure 9A:
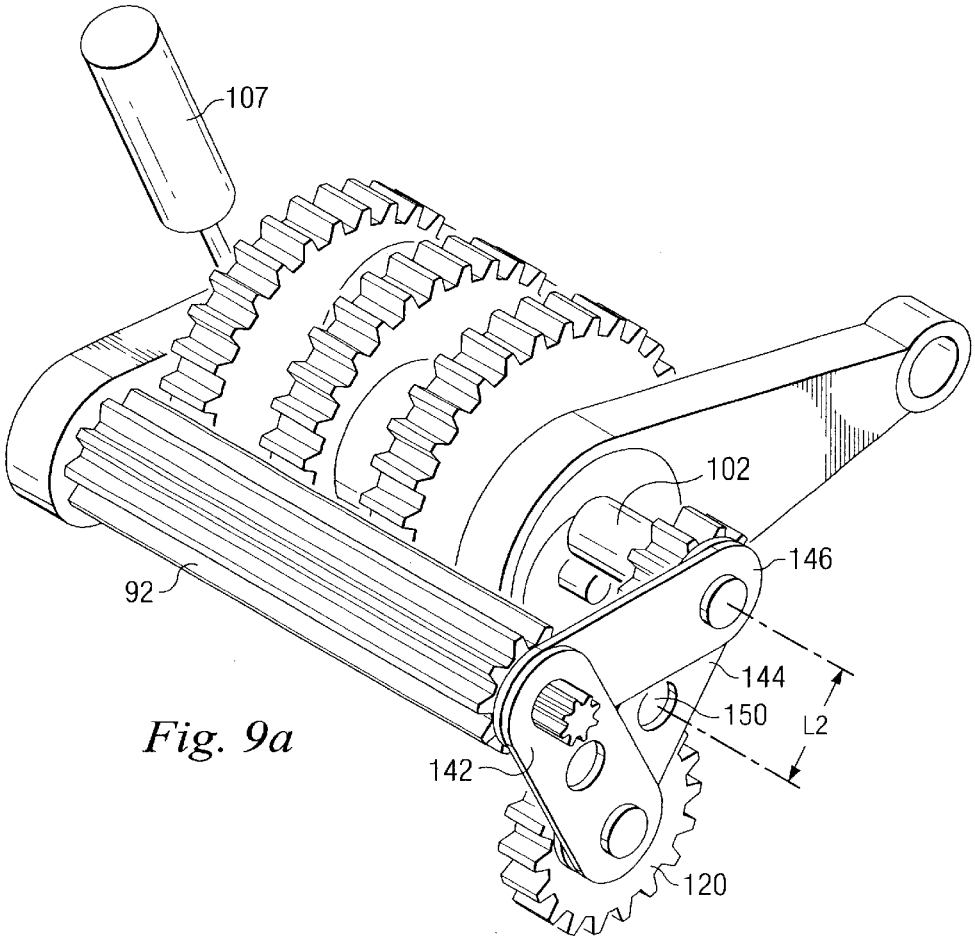
FIG. 9*a* is an isometric view of the system of FIG. 9 with additional components.

FIG. 9*a* illustrates the system 90 of FIG. 9 with the addition of three connecting members 142, 144, and 146. The connecting member 142 couples the shaft of the drive gear 92 to the shaft of the connecting gear 120. Similarly, the connecting member 144 couples the shaft of the connecting gear 120 to the control shaft 102. The connecting member 146 couples the control shaft 102 to the shaft of the drive gear 92. Alternatively, the connecting members 142, 144, and 146 could be replaced by a single connecting member because in this embodiment, the shafts for the drive gear 92, the connecting gear 120, and the control shaft 102 do not move relative to each other.

A pivot point 150 is positioned on the connecting member 144. The connecting member 144 and the entire system 90 can be rotated about the pivot point 150, which is stationary relative to the cylinder (not shown) of the system 90. As the hydraulic cylinder 107, i.e., adjusting mechanism, rotates the connecting member 144 and the system 90 around the pivot point 150, the stroke length and the unswept volume will change in response to the rotation. Thus, the stroke length and the unswept volume can be controlled by adjusting the degree of rotation around the pivot point 150. Conversely, the location of the pivot point 150, (e.g., the longitudinal distance (L2) of the pivot point 150 from the center of the control gear 104) can also be positioned to affect the unswept volume or the fixed compression ratio for the system.

Thus, it is possible to keep the unswept volume constant by positioning the pivot point 150 at a predetermined distance L2 from the center of the crankshaft 94. As previously described, in this embodiment, the rotatable cams 100*a*–100*c* rotate in an opposite direction to the fixed cams 98*a*–98*c*, respectively. However, the angular velocities are the same magnitude. In order for the fixed cams 98*a*–98*c* to have the same, but opposite magnitude from rotatable cams 100*a*–100*c*, the ratio of the gearing is as follows:

$$D5/D3=(D1/D2+1)/2.$$

As discussed previously, one skilled in the art would recognize that the maximum stroke and the minimum stroke can be achieved by a 180 degree rotation of the rotatable cam 100*a*. The required distance L2 to maintain a constant unswept volume, therefore, may be calculated by the following formula:

$$L2=E/(\tan(\alpha/2)$$

where $\alpha$=N5*D5/D4*360 (in degrees),

N5=N6=D7/(2*D6), and

E is the eccentricity of the fixed cams 98*a*.

On the other hand, if it is desired to maintain a constant compression ratio rather than a constant unswept length, the required distance L2 can be determined from the following formula:

$$L2=(E+EX/(S+E))/\tan(\alpha/2)$$

where S is the medium stroke of the system,

S+E is the maximum stroke of the system,

S−E is the minimum stroke of the system,

X is the unswept length at the maximum stroke, and

Y is the unswept length at the minimum stroke (or Y=(S−E)*X/(S+E)).

Thus, it is possible to configure this embodiment to either achieve a constant unswept volume or a constant compression ratio. It is also possible to have configurations where the unswept volume and the compression ratio are varied by varying the distance L2.

The operation of this configuration is similar to that described above with reference to FIG. 6, except that the hydraulic cylinder 107 rotates the entire system 90 around the pivot point 150 to either control the unswept volume or the compression ratio.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the claims appended hereto and their equivalents.

What is claimed is:

1. A piston system, comprising:

a shaft adapted to rotate about its center;

a cylindrical volume;

a piston disposed in the cylindrical volume, wherein the piston is adapted to slidably move within the cylindrical volume;

a linkage coupling the shaft to the piston;

a first adjusting mechanism to adjust the relative position of the linkage to the center of the shaft thereby changing the stroke length of the piston; and a second adjusting mechanism coupled to the shaft for moving the center of the shaft relative to the cylindrical volume to control an unswept volume in the cylindrical volume.

2. The piston system of claim 1, further comprising:

an input power gear; and an outer gear concentrically positioned about the shaft, wherein the outer gear is adapted to engage the input power gear.

3. The piston system of claim 2, further comprising a fixed cam eccentrically positioned about the center of the shaft.

4. The piston system of claim 3, wherein the first adjusting mechanism comprises a rotatable cam coupled to the fixed cam, and the rotatable cam is adapted to couple to an end of the linkage.

5. The piston system of claim 4, further comprising a secondary control gear coupled to the shaft, wherein the secondary control gear is adapted to engage the rotatable cam to rotate the rotatable cam.

6. The piston system of claim 5, wherein the linkage comprises a connecting rod having a first end adapted to couple with the rotatable cam and a second end adapted to couple with the piston.

7. The piston system of claim 6, wherein the second adjusting mechanism is selected from the group consisting of a screw type actuator and a hydraulic cylinder.

8. The piston system of claim 6, further comprising:

a primary control gear coupled to the shaft; and a connector gear adapted to engage the input power gear and the primary control gear.

9. The piston system of claim 8, further comprising a connecting member coupling a shaft of the primary control gear to a shaft of the connector gear, wherein the connecting member is adapted to rotate about a pivot point.

10. The piston system of claim 6, further comprising:

a primary control gear coupled to the shaft;

a first connector gear adapted to engage the input power gear; and a second connector gear adapted to engage the first connecting gear and the primary control gear.

11. A piston system, comprising:

a shaft having a longitudinal axis;

a concentric wheel coupled to the shaft;

a fixed cam coupled to the concentric wheel;

a rotatable cam coupled to the fixed cam, wherein the rotatable cam is adapted to rotate with respect to the fixed cam;

a piston coupled to the rotatable cam, wherein the piston is adapted to slidably move within a cylindrical volume; and an adjusting mechanism coupled to the shaft and adapted to move the longitudinal axis of shaft relative to the cylindrical volume;

an input power gear coupled to the concentric wheel;

a control gear coupled to the shaft; and a connector gear adapted to engage the input power gear and the control gear.

12. The piston system of claim 11, further comprising a connecting member coupling a shaft of the control gear to a shaft of the connector gear, wherein the connecting member is adapted to rotate about a pivot point.

13. A piston system, comprising:

a shaft having a longitudinal axis;

a concentric wheel coupled to the shaft;

a fixed cam coupled to the concentric wheel;

a rotatable cam coupled to the fixed cam, wherein the rotatable cam is adapted to rotate with respect to the fixed cam;

a piston coupled to the rotatable cam, wherein the piston is adapted to slidably move within a cylindrical volume;

an adjusting mechanism coupled to the shaft and adapted to move the longitudinal axis of shaft relative to the cylindrical volume;

an input power gear coupled to the concentric wheel;

a control gear coupled to the shaft;

a first connector gear adapted to engage the input power gear; and a second connector gear adapted to engage the first connector gear and the control gear.

14. The piston system of claim 13, further comprising a connecting member coupling a shaft of the control gear to a shaft of the second connector gear, wherein the connecting member is adapted to rotate about a pivot point.

* * * * *